US010938121B2

(12) United States Patent
Chiang et al.

(10) Patent No.: US 10,938,121 B2
(45) Date of Patent: Mar. 2, 2021

(54) ANTENNA MODULE OF IMPROVED PERFORMANCES

(71) Applicant: MEDIATEK Inc., Hsin-Chu (TW)

(72) Inventors: Chung-Hsin Chiang, Hsin-Chu (TW); Shih-Huang Yeh, Hsin-Chu (TW)

(73) Assignee: MEDIATEK INC., Hsin-Chu (TW)

( * ) Notice: Subject to any disclaimer, the term of this patent is extended or adjusted under 35 U.S.C. 154(b) by 0 days.

(21) Appl. No.: 16/524,282

(22) Filed: Jul. 29, 2019

(65) Prior Publication Data

US 2020/0076092 A1 Mar. 5, 2020

Related U.S. Application Data

(60) Provisional application No. 62/726,476, filed on Sep. 4, 2018.

(51) Int. Cl.
*H01Q 21/06* (2006.01)
*H01Q 5/50* (2015.01)
*H01Q 19/00* (2006.01)

(52) U.S. Cl.
CPC ..... *H01Q 21/065* (2013.01); *H01Q 5/50* (2015.01); *H01Q 19/005* (2013.01)

(58) Field of Classification Search
CPC .... H01Q 21/06; H01Q 21/061; H01Q 21/065; H01Q 21/24; H01Q 5/392; H01Q 5/50; H01Q 19/00; H01Q 19/005; H01Q 9/04; H01Q 9/0407
See application file for complete search history.

(56) References Cited

U.S. PATENT DOCUMENTS 6,091,365 A * 7/2000 Derneryd ..... H01Q 1/246 343/700 MS
6,133,882 A * 10/2000 LaFleur ..... H01Q 1/38 343/700 MS
6,211,841 B1 4/2001 Smith et al.
6,281,849 B1 * 8/2001 Brachat ..... H01Q 21/24 343/700 MS (Continued)

FOREIGN PATENT DOCUMENTS

CN 101573831 A 11/2009
CN 203942014 U 11/2014

(Continued)

OTHER PUBLICATIONS

TW Office Action dated May 7, 2020 in Taiwan application (No. 108130885).

(Continued)

*Primary Examiner* — Jason Crawford
(74) *Attorney, Agent, or Firm* — McClure, Qualey & Rodack, LLP

(57) ABSTRACT

The invention provides an antenna module of improved performances; the antenna module may comprise a plurality of first antennas for signaling at a first band, and a plurality of second antennas for signaling at a second band different from the first band. Each said first antenna may comprise a main radiator which resonates at a mode-one frequency and a mode-two frequency different from the mode-one frequency; and the main radiator may be configured such that the mode-one frequency may be in the first band, and the mode-two frequency may not be in the first band and the second band.

20 Claims, 11 Drawing Sheets

(56) References Cited

U.S. PATENT DOCUMENTS 6,937,206 B2 8/2005 Puente Baliarda et al.
8,279,121 B2 10/2012 Ishizuka et al.
9,548,526 B2 1/2017 Lu et al.
10,608,344 B2 * 3/2020 Paulotto ..... H01Q 19/32
2002/0047803 A1 * 4/2002 Ishitobi ..... H01Q 9/0457 343/700 MS
2003/0071763 A1 * 4/2003 McKinzie, III ..... H01Q 5/357 343/909
2004/0004579 A1 * 1/2004 Manzione ..... H01Q 21/065 343/893
2004/0140862 A1 * 7/2004 Brown ..... G01P 15/0802 333/117
2005/0110683 A1 * 5/2005 Song ..... H01Q 25/00 343/700 MS
2010/0171675 A1 * 7/2010 Borja ..... H01Q 9/0414 343/798
2011/0109524 A1 5/2011 Saily
2012/0287000 A1 * 11/2012 Ando ..... H01Q 9/0407 343/700 MS
2013/0285852 A1 * 10/2013 Teillet ..... H01Q 3/38 342/368
2016/0036130 A1 * 2/2016 Hsu ..... H01Q 9/0457 343/848
2017/0358863 A1 * 12/2017 Stepanenko ..... H01Q 9/045
2018/0097293 A1 * 4/2018 Piegsa ..... H01Q 5/392
2018/0108989 A1 * 4/2018 De Flaviis ..... H01Q 9/0435
2018/0191083 A1 * 7/2018 Daojian ..... H01Q 5/30
2019/0020110 A1 * 1/2019 Paulotto ..... H01Q 19/005
2019/0081414 A1 * 3/2019 Kao ..... H01Q 25/001
2019/0148839 A1 * 5/2019 Lin ..... H01Q 1/38 343/700 R
2020/0044327 A1 * 2/2020 Ding ..... H01Q 1/38
2020/0161748 A1 * 5/2020 Isik ..... H01Q 9/16

FOREIGN PATENT DOCUMENTS

CN 108258415 A 7/2018
TW 201136025 A 10/2011
TW 201427178 A 7/2014

OTHER PUBLICATIONS

CN Office Action dated Aug. 31, 2020 in Chinese application (No. 201910794432.7).

* cited by examiner

ANTENNA MODULE OF IMPROVED PERFORMANCES

This application claims the benefit of U.S. provisional application Ser. No. 62/726,476, filed Sep. 4, 2018, the subject matter of which is incorporated herein by reference.

FIELD OF THE INVENTION

The present invention relates to an antenna module of improved performances, and more particularly, to a multi-band antenna module which may include a high-band antenna array and a low-band antenna array for signaling at a high-band and a low-band respectively, and may improve performances (e.g., array gain) of the high-band antenna array by configuring each low-band antenna to cause a high-order resonance frequency of each low-band antenna not to locate in the high-band.

BACKGROUND OF THE INVENTION

Antenna module is essential for electronic devices which require radio functionality, such as mobile phones which require mobile telecommunication. Modern advanced radio functionality, such as 5G (fifth generation) mobile telecommunication, demands a multi-band antenna module capable of signaling (transmitting and/or receiving) at multiple radio bands of different frequencies. In addition, limited form factor of modern electronic device constrains sizes of antenna module.

FIG. 1 illustrates a conventional multi-band antenna module 100, which includes low-band antennas pa[1] to pa[4] forming a 2*2 low-band antenna array 102 for signaling at a predefined low-band B1 between frequencies fB11 and fB12, and high-band antennas pb[1] to pb[4] forming a 2*2 high-band antenna array 104 for signaling at a predefined high-band B2 between frequencies fB21 and fB22. Each of the low-band antenna pa[n] (n=1 to 4) is a patch antenna of a plain square shape. For compactness, positions of the low-band antennas pa[1] to pa[4] and the high-band antennas pb[1] to pb[4] are arranged to be interleaved.

However, it is found that the high-band antenna array 104 of the antenna module 100 suffers performance degradation. As also shown in FIG. 1, a curve 12 depicts s-parameter of each high-band antenna pb[k] (k=1 to 4), and a curve 14 depicts array gain of the high-band antenna array 104. Since the high-band antenna array 104 is expected to signal at the predefined high-band B2, the s-parameter curve 12 of each high-band antenna pb[k] is expected to have a notch across the high-band B2. However, as shown in FIG. 1, the s-parameter curve 12 suffers an undesired bulge rising against the desired notch around a frequency fd0. Similarly, around the frequency fd0, the array gain curve 14 of the antenna array 104 suffers an undesired gain drop falling against a desired bump across the high-band B2.

SUMMARY OF THE INVENTION

An objective of the invention is providing an antenna module (e.g., anyone of 200, 300, 400*a*-400*d*, 500*a*-500*d* and 600 in FIGS. 2*a*, 3, 4*a*-4*d*, 5*a*-5*d* and 6) of improved performances. The antenna module may include a plurality of first antennas (e.g., one of a[n] and aa[n] to ad[n] in FIGS. 2*b* and 4*a*-4*d*) for signaling at a first band (e.g., B1 in FIGS. 2*a* and 4*a*-4*d*), and a plurality of second antennas (e.g., b[k] in FIG. 2*a*) for signaling at a second band (e.g., B2 in FIGS. 2*a* and 4*a* to 4*d*) different from the first band. Wherein each said first antenna may include a main radiator (e.g., one of M1 and Ma1-Md1 in FIGS. 2*b* and 4*a*-4*d*) which may resonate at a mode-one frequency (e.g., one of fL1 and faL1-fdL1 in FIGS. 2*b* and 4*a*-4*d*) and a mode-two frequency (e.g., one of fL2 and faL2-fdL2 in FIGS. 2*b* and 4*a*-4*d*) different from the mode-one frequency, and the main radiator may be configured such that the mode-one frequency may be in (or near) the first band, and the mode-two frequency may not be in the first band and the second band.

In an embodiment (e.g., one of FIGS. 2*a*, 4*b* and 4*c*), the main radiator (e.g., one of M1, Mb1 and Mc1 in FIGS. 2*b*, 4*b* and 4*c*) may be configured such that the mode-two frequency (e.g., one of fL2, fbL2 and fcL2 in FIGS. 2*b*, 4*b* and 4*c*) may be between the first band and the second band.

In an embodiment (e.g., FIG. 4*a*), the main radiator (e.g., Ma1 in FIG. 4*a*) may be configured such that the mode-two frequency (e.g., faL2 in FIG. 4*a*) may be higher than the first band and the second band.

In an embodiment (e.g., one of FIGS. 2*a* and 4*a*-4*d*), the main radiator (e.g., one of M1 and Ma1-Md1 in FIGS. 2*b* and 4*a*-4*d*) may include a basic patch (e.g., one of A1 and Aa1-Ad1 in FIGS. 2*b* and 4*a*-4*d*) and at least one peripheral feature (e.g., one of e[i] and ea[i]-ed[i] in FIGS. 2*b* and 4*a*-4*d*) at a boundary of the basic patch, for tuning the mode-two frequency (e.g., one of fL2 and faL2-fdL2 in FIGS. 2*b* and 4*a*-4*d*) out of the second band.

In an embodiment (e.g., one of FIGS. 2*a* and 4*a*-4*d*), a shape of the basic patch (e.g., one of A1 and Aa1-Ad1 in FIGS. 2*b* and 4*a*-4*d*) may be a polygon, and each said peripheral feature (e.g., one of e[i] and ea[i]-ed[i] in FIGS. 2*b* and 4*a*-4*d*) may be at a corner of the basic patch.

In an embodiment (e.g., FIG. 2*b*), each said peripheral feature (e.g., e[i] in FIG. 2*b*) may be an extension patch extending outwards from the boundary of the basic patch (e.g., A1 in FIG. 2*b*).

In an embodiment (e.g., one of FIGS. 2*b* and 4*a*), a shape of each said peripheral feature (e.g., e[i] or ea[i] in FIG. 2*b* or 4*a*) may be a polygon.

In an embodiment (e.g., FIG. 4*a*), each said peripheral feature (e.g., ea[i] in FIG. 4*a*) may be an indentation extending inwards from the boundary of the basic patch (e.g., Aa1 in FIG. 4*a*).

In an embodiment (e.g., FIG. 4*b*), each said peripheral feature (e.g., eb[i] in FIG. 4*b*) may a meander line.

In an embodiment (e.g., FIG. 4*c*), each said peripheral feature (e.g., ec[1] in FIG. 4*c*) may include one or more slits (e.g., e11 to e13 in FIG. 4*c*).

In an embodiment (e.g., FIG. 4*d*), each said peripheral feature (e.g., ed[i] in FIG. 4*d*) may be a capacitor connected between a ground plane (e.g., G in FIG. 4*d*) and the basic patch (e.g., Ad1 in FIG. 4*d*).

In an embodiment (e.g., one of FIGS. 2*b* and 4*a*-4*d*), a shape of the basic patch (e.g., one of A1 and Aa1-Ad1 in FIGS. 2*b* and 4*a*-4*d*) may be a square.

In an embodiment (e.g., FIG. 3 or 6), the antenna module (e.g., 300 or 600 in FIG. 3 or 6) may further include one or more parasitic elements (e.g., H[n], V[n] in FIG. 3, or R[n], L[n] in FIG. 6) near at least one of the plurality of first antennas, for enhancing a bandwidth of the plurality of first antennas.

In an embodiment (e.g., FIG. 5*a* or 5*d*), a side (e.g., sa1 in FIG. 5*a* or 5*d*) of each said first antenna may be parallel to a corresponding side (e.g., sb1 in FIG. 5*a* or 5*d*) of each said second antenna.

In an embodiment (e.g., FIG. 5*c* or 5*d*), a side (e.g., sa1 in FIG. 5*c* or 5*d*) of each said first antenna may not be parallel to any side (e.g., sb1 or sb2 in FIG. 5*c* or 5*d*) of each said second antenna.

An objective of the invention is providing an antenna module (e.g., anyone of 200, 300, 400*a*-400*d*, 500*a*-500*d* and 600 in FIGS. 2*a*, 3, 4*a*-4*d*, 5*a*-5*d* and 6) of improved performances. The antenna module may include a plurality of first antennas (e.g., one of a[n] and aa[n]-ad[n] in FIGS. 2*a* and 4*a*-4*d*) for signaling at a first band (e.g., B1 in FIGS. 2*a* and 4*a*-4*d*), and a plurality of second antennas (e.g., b[k] in FIG. 2*a*) for signaling at a second band (e.g., B2 in FIGS. 2*a* and 4*a*-4*d*) different from the first band. Each said first antenna may resonate at a mode-one frequency (e.g., one of fL1 and faL1-fdL1 in FIGS. 2*b* and 4*a*-4*d*) and a mode-two frequency (e.g., one of fL2 and faL2-fdL2 in FIGS. 2*b* and 4*a*-4*d*) different from the mode-one frequency; the mode-one frequency may be in (or near) the first band, and each said first antenna may include at least one peripheral feature (e.g., one of e[i] and ea[i]-ed[i] in FIGS. 2*b* and 4*a*-4*b*) for tuning the mode-two frequency out of the second band.

Numerous objects, features and advantages of the present invention will be readily apparent upon a reading of the following detailed description of embodiments of the present invention when taken in conjunction with the accompanying drawings. However, the drawings employed herein are for the purpose of descriptions and should not be regarded as limiting.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

Figure 1:
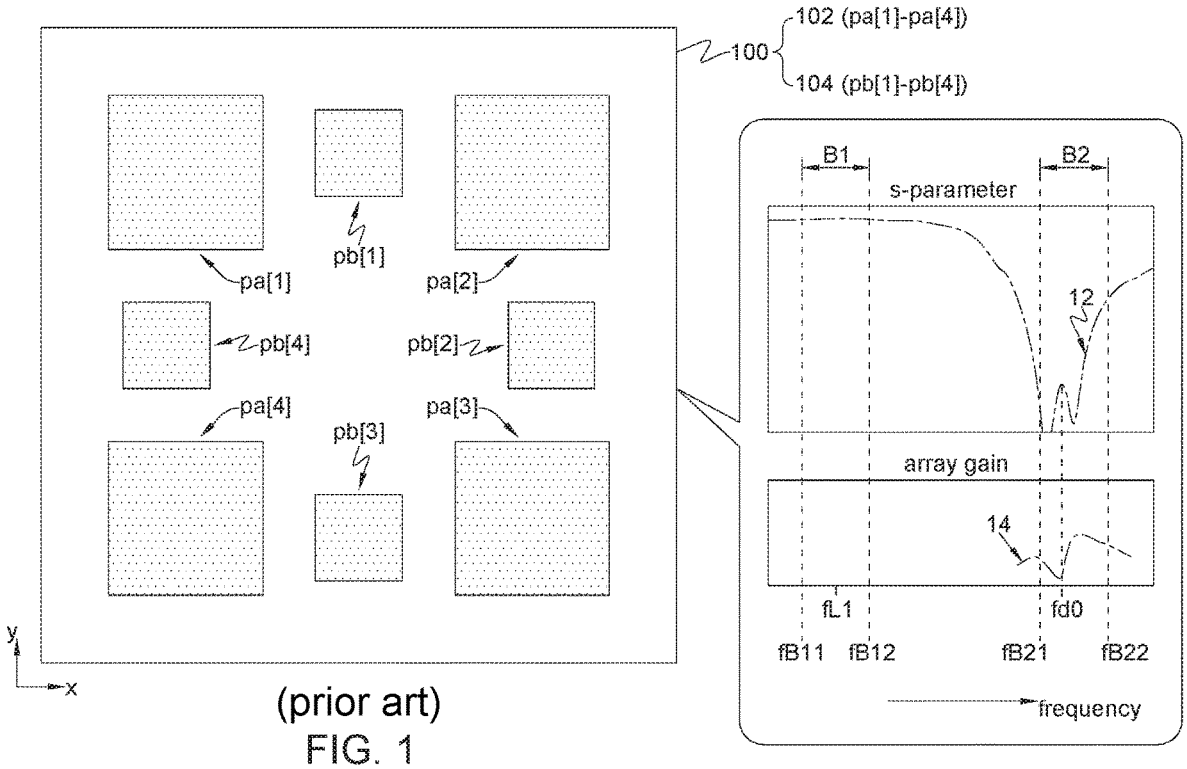
(prior art) FIG. 1
FIG. 1 (prior art) illustrates a conventional antenna module.

When researching the performance degradation of the conventional antenna module 100 in FIG. 1, inventors of the invention find that the degradation of the high-band antenna array 104 is caused by a high-order resonance of each low-band antennas pa[n]. For signaling at the low-band B1, a fundamental mode (e.g., TM01 or TM10, with TM being transverse magnetic) of each low-band antenna pa[n] is designed to resonate along a side of each antenna pa[n]; however, other high-order modes also exist, such as a high-order mode (e.g., TM11) which resonates along a diagonal of each antenna pa[n]. Under such circumstance, a fundamental resonance frequency of the fundamental mode will relate to a side length of each antenna pa[n], and a high-order resonance frequency of said high-order mode will relate to a diagonal length of each antenna pa[n].

For each low-band antenna pa[n] to signal at the low-band B1, the fundamental resonance frequency of each antenna pa[n] is designed to locate in the low-band B1 by controlling sizes (side lengths) of each antenna pa[n]; however, due to the plain square shape of each antenna pa[n], the diagonal length of each antenna pa[n] will inevitably cause the high-order resonance frequency of each low-band antenna pa[n] to locate in the high-band B2 when the antenna module 100 needs to comply with a telecommunication standard in which a frequency ratio between the predefined bands B2 and B1 happens to approximate a ratio between the diagonal length and the side length of each antenna pa[n]. Consequently, when the high-band antenna array 104 signals at the high-band B2, the nearby low-band antennas pa[1] to pa[4] will also be induced to resonate at the high-order resonance frequency of each antenna pa[n], and therefore interfere and degrade expected performances of the high-band antenna array 104 around the high-order resonance frequency of each antenna pa[n], as indicated by the frequency fd0 in FIG. 1. It is therefore understood that, under the plain square shape design of each conventional low-band antenna pa[n], the diagonal length of each antenna pa[n] will excite high-order mode to cause performance degradation of each high-band antenna pb[k] and the high-band antenna array 104.

Figure 2A:
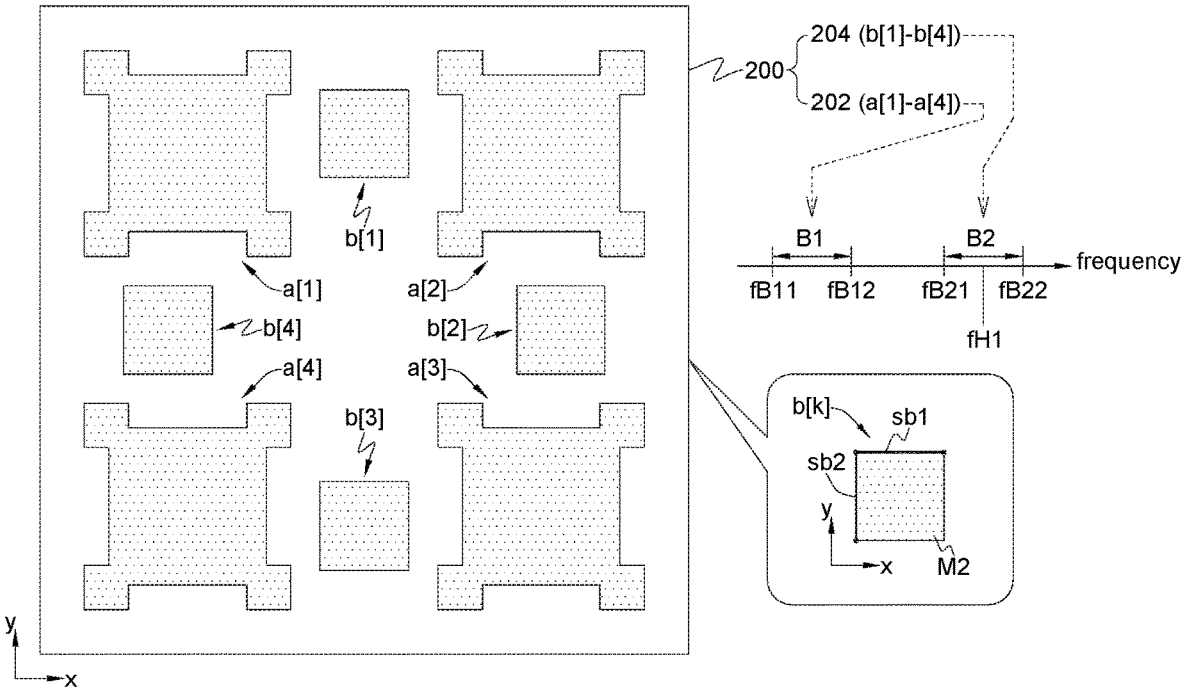
FIGS. 2*a* and 2*b* illustrate an antenna module according to an embodiment of the invention.

FIG. 2*a* illustrates a top view of an antenna module 200 according to an embodiment of the invention. The antenna module 200 may a multi-band (e.g., dual-band) antenna module, and may include a plurality of low-band antennas, e.g., a[1] to a[4], and a plurality of high-band antennas, e.g., b[1] to b[4] distributed along an x-y plane. The low-band antennas a[1] to a[4] may form a low-band antenna array 202 for signaling at a predefined low-band B1 between frequencies fB11 and fB12, and the high-band antennas b[1] to b[4] may form a high-band antenna array 204 for signaling at a different predefined high-band B2 between frequencies fB21 and fB22. In an embodiment, the band B2 may be higher than the band B1, and the bands B1 and B2 may not overlap; i.e., the lower-bound frequency fB21 of the band B2 may be higher than the upper-bound frequency fB12 of the band B1. For example, in an embodiment, the low-band B1 may be between 24.25 and 29.5 GHz, and the high-band B2 may be between 37.0 and 43.5 GHz. For compactness of the antenna module 200, positions the low-band antennas a[1] to a[4] and the high-band antennas b[1] to b[4] may be arranged to be interleaved; for example, a distance between a low-band antenna and its nearest high-band antenna (e.g., a[1] and b[1]) may be shorter than a distance between two closest low-band antennas (e.g., a[1] and a[2]), and may also be shorter than a distance between two closest high-band antennas (e.g., b[1] and b[2]).

In an embodiment, each high-band antenna b[k] (k=1 to 4) may be a patch antenna; as shown in FIG. 2*a*, each high-band antenna b[k] may include at least one patch M2; the patch M2 may be a planer conductor parallel to the x-y plane. In an embodiment, each high-band antenna b[k] may resonate at a frequency fH1 located in the band B2, so the high-band antenna array 204 may signal at the band B2 for communication. In an embodiment, each high-band antenna b[k] may be a dual-polarization patch antenna, and a shape of each patch (e.g., M2) of each high-band antenna b[k] may be a square.

Figure 2B:
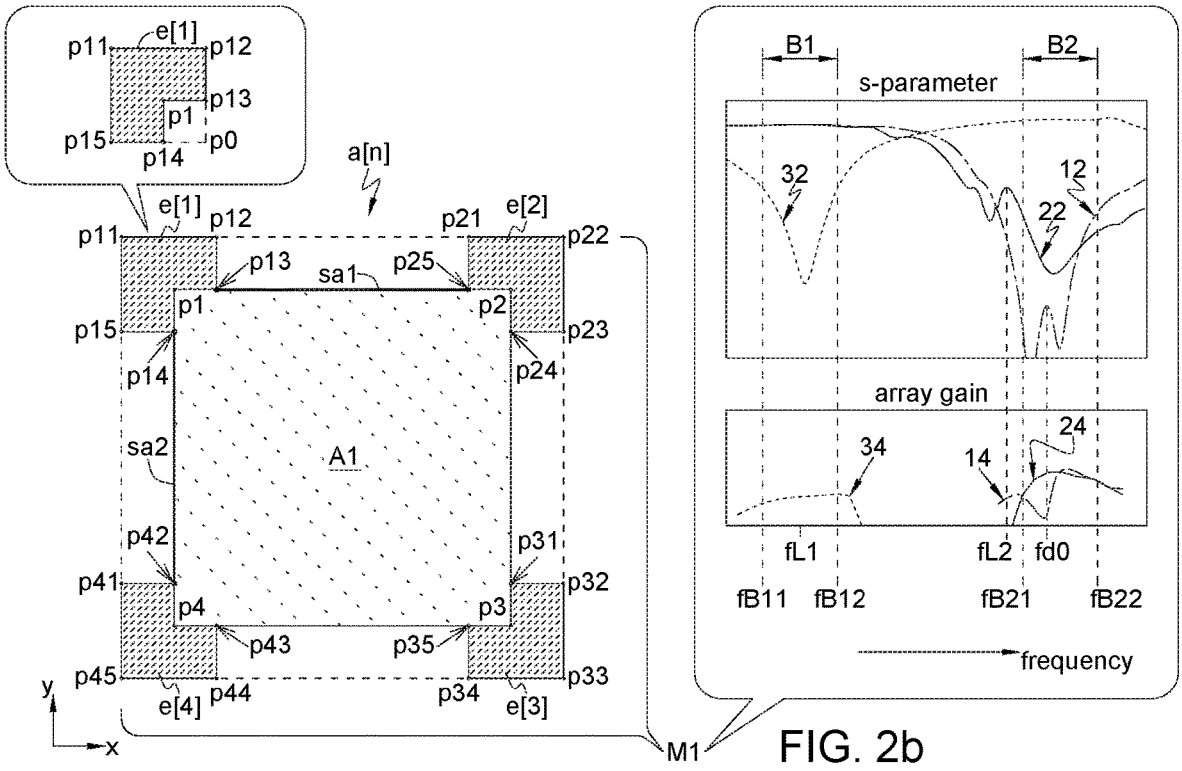

Along with FIG. 2*a*, FIG. 2*b* illustrates a top view of each low-band antenna a[n] (for n=1 to 4). The low-band antenna a[n] may include at least a main radiator M1. The main radiator M1 may resonate at a mode-one frequency fL1 and a mode-two frequency fL2 higher than the mode-one frequency fL1. For example, the lower mode-one frequency fL1 may be a fundamental resonance frequency in a fundamental mode of the main radiator M1, and the higher mode-two frequency fL2 may be a high-order resonance frequency in one of high-order modes of the main radiator M1. To signal at the low-band B1, the main radiator M1 may be configured such that the frequency fL1 may be in the band B1; moreover, to avoid performance degradation happened to the high-band antenna array 104 (FIG. 1) of the conventional antenna module 100, the main radiator M1 of the invention may be further configured such that the mode-two frequency fL2 may not be in the bands B1 and B2. For example, the main radiator M1 may be configured such that the mode-two frequency fL2 may be between the bands B1 and B2; i.e., between the upper-bound frequency fB12 of the low-band B1 and the lower-bound frequency fB21 of the high-band B2, as shown in FIG. 2*b*.

As shown in FIG. 2*b*, the main radiator M1 may include a conductive basic patch A1 and at least one peripheral feature, such as e[1], e[2], e[3] and e[4], at a boundary of the basic patch A1, for tuning the mode-two frequency fL2 out of the high-band B2. A shape of the basic patch A1 may be a polygon with vertices at points p1, p2, p3 and p4, and each of the peripheral patch e[i] (for i=1 to 4) may be arranged at a corresponding corner of the basic patch A1; e.g., the peripheral feature e[1] may locate at the left-top corner (the point p1) of the basic patch A1. In the embodiment shown in FIG. 2*b*, each of the peripheral feature e[i] may be a conductive extension patch extending outwards from the boundary of the basic patch A1, and a shape of each peripheral feature e[i] may be a polygon; e.g., the shape of the peripheral feature e[1] may be a polygon with vertices at points p11, p12, p13, p1, p14 and p15, the shape of the peripheral feature e[2] may be a polygon with vertices at points p21, p22, p23, p24, p2 and p25, the shape of the peripheral feature e[3] may be a polygon with vertices at points p31, p32, p33, p34, p35 and p3, and the shape of the peripheral feature e[4] may a polygon with vertices at points p41, p42, p4, p43, p44 and p45, wherein the points p13 and p25 may be on a boundary segment p1-p2 (i.e., a line segment between the points p1 and p2) of the basic patch A1, the points p24 and p31 may be on a boundary segment p2-p3 of the basic patch A1, the points p35 and p43 may be on a boundary segment p3-p4 of the basic patch A1, and the points p14 and p42 may be on a boundary segment p1-p4 of the basic patch A1. With the basic patch A1 and the peripheral features e[1] to e[4] conductively connected together, the main radiator M1 may be a planar patch parallel to the x-y plane, and a shape of the main radiator M1 may be a complex polygon with vertices at the points p11, p12, p13, p25, p21, p22, p23, p24, p31, p32, p33, p34, p35, p43, p44, p45, p41, p42, p14 and p15.

In an embodiment, each antenna a[n] may be a dual-polarization antenna, a shape of the basic patch A1 may be a square, and the shapes of the peripheral features e[1] to e[4] may be designed such that the shape of the main radiator M1 may be rotationally symmetric under 90-degree rotation; for example, each peripheral feature e[i] may be a smaller square with a corner clipped by a tiny square, e.g., the peripheral feature e[1] may be formed by dipping a tiny square (with vertices at points p1, p13, p0 and p14) from a small square (with vertices at points p11, p12, p0 and p15) at a corner (point p0) of the small square, wherein the small square p11-p12-p0-p15 may be smaller than the basic patch A1. In an embodiment, a boundary segment p11-p12 of the peripheral feature e[1] and a boundary segment p21-p22 of the peripheral feature e[2] may be collinear, a boundary segment p22-p23 of the peripheral feature e[2] and a boundary segment p32-p33 of the peripheral feature e[3] may be collinear, a boundary segment p33-p34 of the peripheral feature e[3] and a boundary segment p44-p45 of the peripheral feature e[4] may be collinear, and a boundary segment p41-p45 of the peripheral feature e[4] and a boundary segment p11-p15 of the peripheral feature e[1] may be collinear; and, in an embodiment, a geometric polygon with vertices at the points p11, p22, p33 and p45 may be a large square enclosing the basic patch A1. From an aspect, the shape of the main radiator M1 may be formed by the polygon p11-p22-p33-p45 with four indentations defined by polylines p12-p13-p25-p21, p23-p24-p31-p32, p34-p35-p43-p44 and p41-p42-p14-p15.

By the peripheral features e[1] to e[4] of the main radiator M1, the high-order resonance frequency fL2 of the main radiator M1 may be configured to be outside of the high-band B2. The frequency fL2 relates to the diagonal length of the main radiator M1. If the main radiator M1 of the low-band antenna a[n] only contains the basic patch A1 without the peripheral features e[1] to e[4] and is therefore shaped similar to the plain square of the conventional low-band antenna pa[n] (FIG. 1), then the frequency fL2 of the main radiator M1 would fall into the high-band B2, since the diagonal length of such plain square shape is known to cause the high-order resonance frequency to fall in the high-band B2, similar to what happens to the conventional antenna pa[n] in FIG. 1. However, by the peripheral features e[1] to e[4] of the invention, the diagonal length (e.g., from points p11 to p33 or p22 to p45) of the main radiator M1 will be extended to be longer than the diagonal length (e.g., from p1 to p3 or p2 to p4) of the basic patch A1, and the frequency fL2 of the main radiator M1 will therefore be lowered to fall outside of the high-band B2; e.g., be lowered to be lower than the lower-bound frequency fB21 of the high-band B2, as shown in FIG. 2*b*.

Because the invention may configure the high-order resonance frequency fL2 of the main radiator M1 to locate outside of the high-band B2, the antenna module 200 (FIG. 2*a*) according to the invention may effectively avoid performance degradation of the high-band antennas b[1] to b[4] and the high-band antenna array 204. As also shown in FIG. 2*b*, comparing to the s-parameter curve 12 and the array gain curve 14 of each high-band antenna pb[k] (k=1 to 4) and the high-band antenna array 104 of the conventional antenna module 100 (previously shown in FIG. 1), a curve 22 depicting an s-parameter of each high-band antenna b[k] (FIG. 2*a*) of the antenna module 200 will have a desired ideal notch at the high-band B2, and a curve 24 depicting an array gain of the high-band antenna array 204 of the antenna module 200 will not suffer any undesired gain drop. It is also noted that, the peripheral features e[1] to e[4] of the invention will not compromise desired performances of the low-band antenna a[n] and the low-band antenna array 202 at the low-band B1, as shown by a curve 32 depicting an s-parameter of each low-band antenna a[n] of the antenna module 200 and a curve 34 depicting an array gain of the low-band antenna array 202 of the antenna module 200.

In an embodiment, each antenna a[n] may be a simple patch antenna having a single patch, i.e., the main radiator M1, above a ground plane G. In an embodiment, each antenna a[n] may be a stacked patch antenna which may further include at least one secondary radiator M12 (not shown) along with the main radiator M1. For example, in an embodiment, the secondary radiator M12 may be a conductive planar patch parallel to the x-y plane, may be stacked above (or below) the main radiator M1, and may be insulated from the main radiator M1 and the ground plane G. A shape of the secondary radiator M12 may be similar to the shape of the main radiator M1, but sizes of the radiators M1 and M12 may be slightly different. The secondary radiator M12 of the slightly different sizes may help to expand bandwidth of each low-band antenna a[n]. Similar to the antenna a[n], each high-band antenna b[k] (FIG. 2*a*) may be a simple patch antenna or a stacked patch antenna.

In an embodiment, as each low-band antenna a[n] may be a dual-polarization antenna, each antenna a[n] may therefore correspond to two orthogonal feed networks. In an embodiment, each antenna a[n] may utilize direct feed. In an embodiment, each antenna a[n] may utilize slot coupling for feeding. Similar to the low-band antenna a[n], each high-band antenna b[k] may be a dual-polarization antenna (and may correspond to two orthogonal feed networks), and may utilize direct feed or slot coupling for feeding.

As each of the low-band and high-band antennas a[n] and b[k] may be a dual-polarization antenna, each antenna b[k] may resonate at the frequency fH1 (FIG. 2*a*) along two directions u1 and u2 (not shown), and the main radiator M1 of each antenna a[n] may resonate at the frequency fL1 (FIG. 2*b*) along two directions v1 and v2 (not shown). In an embodiment, the resonance directions v1 and v2 may be configured (e.g., by arranging positions of feeding) to be parallel to two sides sa1 and sa2 (i.e., boundary segments p13-p25 and p14-p42 in FIG. 2*b*) of the main radiator M1 (or the basic patch A1, FIG. 2*b*), and the resonance directions u1 and u2 may be configured to be parallel to two sides sb1 and sb2 of each high-band antenna b[k] (or the patch M2 of each antenna b[k], FIG. 2*a*). In an embodiment, the resonance directions v1 and v2 may be configured to be parallel to the two sides sa1 and sa2, while the resonance directions u1 and u2 may be configured to be parallel to two diagonals (not shown) of each high-band antenna b[k] (or the patch M2). In an embodiment, the resonance directions v1 and v2 may be configured to be parallel to two diagonals (i.e., line segments p11-p33 and p22-p45 in FIG. 2*b*) of the main radiator M1, or, to be parallel to two diagonals of the basic patch A1 (i.e., line segments p1-p3 and p2-p4 in FIG. 2*b*); and, the resonance directions u1 and u2 may be configured to be parallel to the two sides sb1 and sb2. In the embodiment, the resonance directions v1 and v2 may be configured to be parallel to the two diagonals of the main radiator M1 (or the two diagonals of the basic patch A1), and the resonance directions u1 and u2 may be configured to be parallel to the two diagonals of each high-band antenna b[k].

In an embodiment, the directions v1 and v2 may be perpendicular, and the directions u1 and u2 may be perpendicular. In an embodiment, each of the directions v1 and v2 may be arranged to be parallel to one of the directions u1 and u2; e.g., the direction v1 may be parallel to the direction u1, and the direction v2 may be parallel to the direction u2. On the other hand, in an embodiment, each of the directions v1 and v2 may not be parallel to anyone of the directions u1 and u2.

Figure 3:
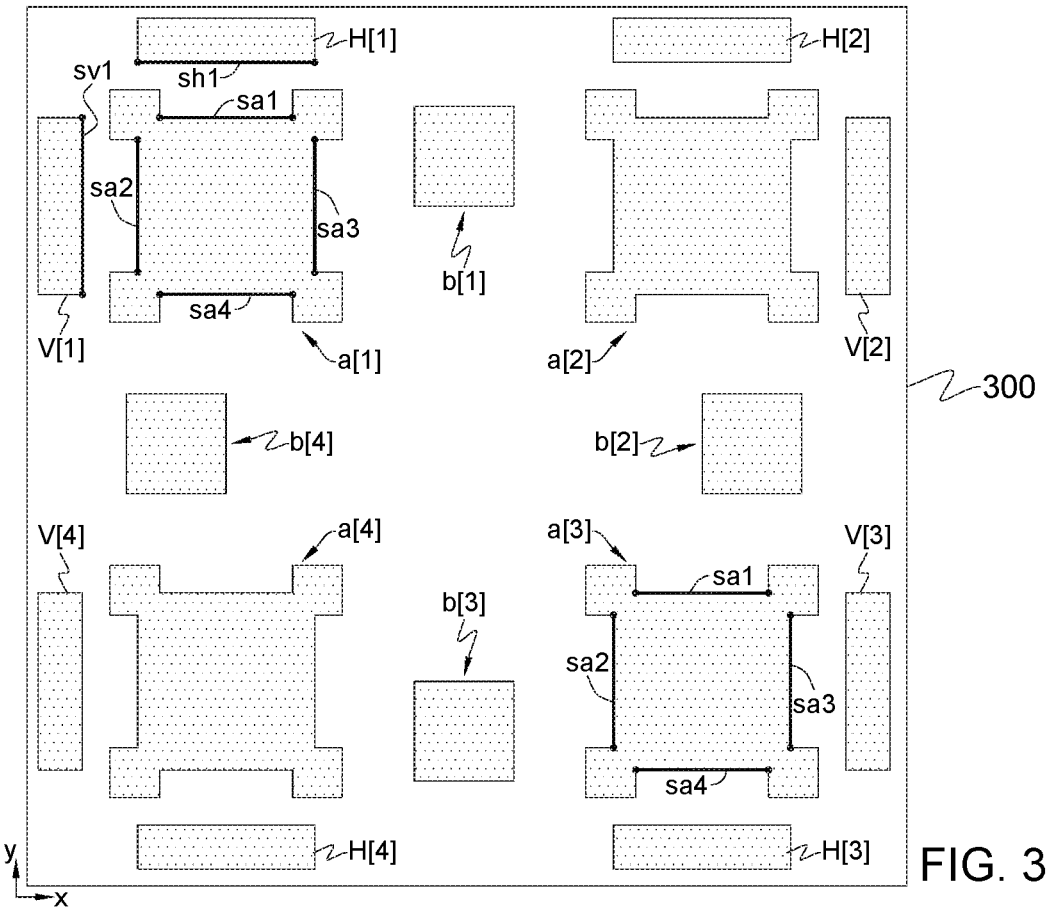
FIGS. 3, 4*a*-4*d*, 5*a*-5*d* and 6 illustrate antenna modules according to different embodiments of the invention.

Along with FIG. 2*a*, FIG. 3 illustrates a top view of an antenna module 300 according to an embodiment of the invention. The antenna module 300 may be derived from the antenna module 200 (FIG. 2*a*) by further including one or more parasitic elements, such as H[1] to H[4] and V[1] to V[4]. For example, each of the parasitic elements H[n] and V[n] (n=1 to 4) may be a planar conductor (e.g., a patch) parallel to the x-y plane, and may be insulated from the antennas a[1] to a[4] and b[1] to b[4]. On the x-y plane, a projection of each of the parasitic elements H[n] and V[n] may be arranged not to overlap with a projection of anyone of the antennas a[1] to a[4] and b[1] to b[4]. In an embodiment, each of the parasitic elements H[n] and V[n] may be disposed near an outward side of each low-band antenna a[n], i.e., a side which is not adjacent to another antenna. For example, the parasitic elements H[1] and V[1] may respectively be placed near the upper side sa1 and the left side sa2 of the antenna a[1], since a lower side sa4 and a right side sa3 of the antenna a[1] are respectively adjacent to the antennas b[4] and b[1]. Similarly, the parasitic elements H[3] and V[3] may be placed near the lower side sa4 and the right side sa3 of the antenna a[3], as the top side sa1 and the left side sa2 of the antenna a[3] are respectively adjacent to the antennas b[2] and b[3]. In an embodiment, a shape of each of the parasitic elements H[n] and V[n] may be a rectangle with two longer sides and two shorter sides; as each of the parasitic elements H[n] and V[n] may be placed close to a nearby side of the antenna a[n], a longer side of the rectangle may be arranged to be parallel to said nearby side; for example, a longer side sh1 of the parasitic element H[1] may be parallel to the side sa1 of the antenna a[1], and a longer side sv1 of the parasitic element V[1] may be parallel to the side sa2 of the antenna a[1]. The parasitic elements H[n] and V[n] arranged near each antenna a[n] may enhance a bandwidth of the antenna a[n].

Figure 4A:
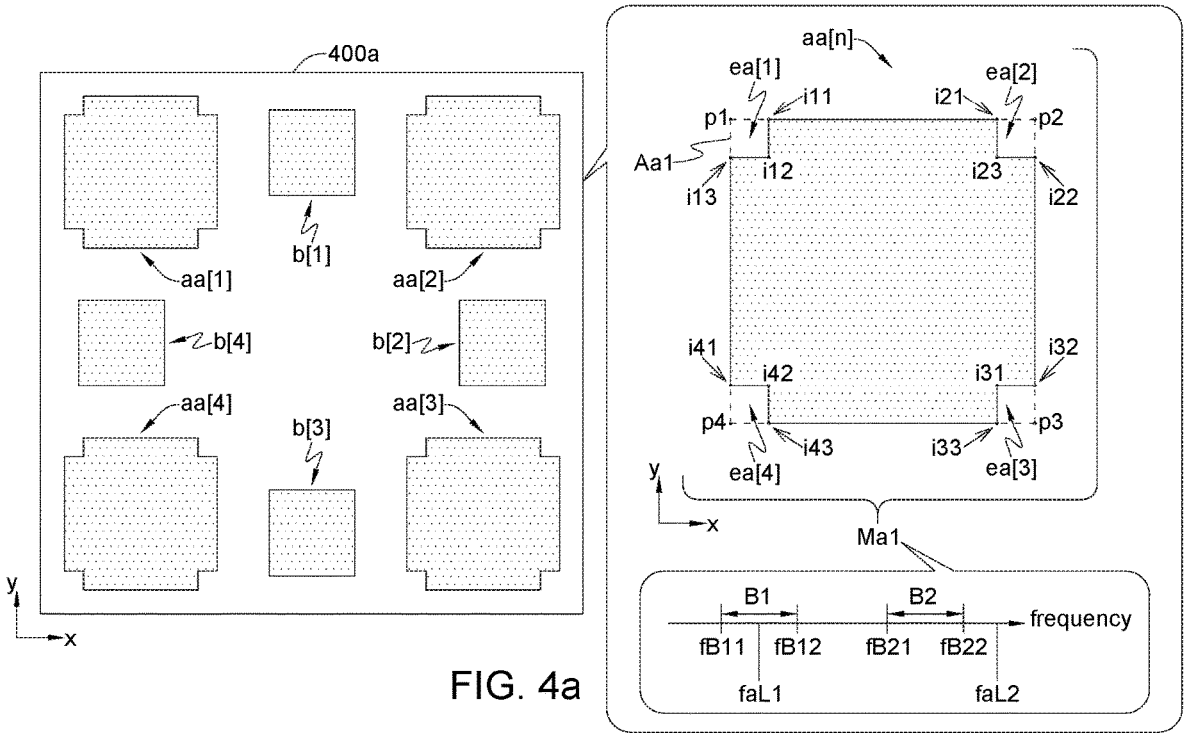

Along with FIG. 2*a*, FIG. 4*a* illustrates a top view of an antenna module 400*a* according to an embodiment of the invention. The antenna module 400*a* in FIG. 4*a* may be derived from the antenna module 200 (FIG. 2*a*) by replacing the low-band antennas a[1] to a[4] with low-band antennas aa[1] to aa[4]. The low-band antennas aa[1] to aa[4] may form a low-band antenna array for signaling at the low-band B1. As shown in FIG. 4*a*, each low-band antenna aa[n] (n=1 to 4) may include a main radiator Ma1, and the main radiator Ma1 may include a basic patch Aa1 and one or more peripheral features, such as ea[1] to ea[4], at a boundary of the basic patch Aa1. The basic patch Aa1 may be a planar conductor parallel to the x-y plane, and a shape of the basic patch Aa1 may be a polygon with vertices at points p1, p2, p3 and p4. Each peripheral feature ea[i] (i=1 to 4) may be at a corner of the basic patch Aa1, and may be an indentation (or a cut-out) extending inwards from the boundary of the basic patch Aa1; for example, the peripheral feature ea[1] may be an indentation dipping a corner of the basic patch Aa1 at the point p1 by a small polygon with vertices at points p1, i11, i12 and i13, the peripheral feature ea[3] may be an indentation dipping an opposite corner of the basic patch Aa1 at the point p3 by a small polygon with vertices at points i31, i31, p3 and i33. As the peripheral features ea[1] to ea[4] respectively dipping four corners of the basic patch Aa1, a shape of the main radiator Ma1 may be a complex polygon with vertices at the points i11, i21, i23, i22, i32, i31, i33, i43, i42, i41, i13 and i12. In an embodiment, each antenna aa[n] may be a dual-polarization antenna, a shape of the basic patch Aa1 may therefore be a square, and shapes of the peripheral features ea[1] to ea[4] may be designed such that a shape of the main radiator Ma1 may be rotationally symmetric under 90-degree rotation; for example, the shape of each peripheral feature ea[i] may be a square smaller than the shape of the basic patch Aa1.

The main radiator Ma1 may resonate at a mode-one frequency faL1 and a mode-two frequency faL2 higher than the frequency faL1; for example, the frequency faL1 may be a fundamental resonance frequency in a fundamental mode of the main radiator Ma1, and the frequency faL2 may be a high-order resonance frequency in a high-order mode of the main radiator Ma1. Sizes (e.g., side lengths) of the basic patch Aa1 may be configured such that the frequency faL1 may locate in the low-band B1, and each low-band antenna aa[n] may therefore signal at the low-band B1 for communication. Furthermore, by the peripheral features ea[1] to ea[4], the main radiator Ma1 may be configured such that the frequency faL2 may not in the high-band B2. The frequency faL2 of the main radiator Ma1 relates to a diagonal length (e.g., distance between the points i12 and i31 or i23 and i42) of the main radiator Ma1. If the main radiator Ma1 only contains the basic patch Aa1 without being dipped by the peripheral features ea[1] to ea[4], the shape of the main radiator Ma1 would degenerate to the plain shape of the basic patch Aa1, and the diagonal length (e.g., distance between the points p1 and p3 or p2 and p4) of such plain shape would cause the frequency faL2 to locate in the high-band B2 to degrade performances of the high-band antennas b[1] to b[4], similar to what happens to the conventional antenna module 100 (FIG. 1). However, because the invention reshapes the basic patch Aa1 of plain rectangular shape to the main radiator Ma1 of complex shape by the peripheral features ea[1] to ea[4], the diagonal length of the main radiator Ma1 may be shortened (e.g., from the distance between the points p1 and p3 to the distance between the points i12 and i31), and the frequency faL2 may therefore be tuned to be out of the high-band B2, e.g., be tuned to be higher than the high-band B2, as shown in FIG. 4*a*.

Figure 4B:
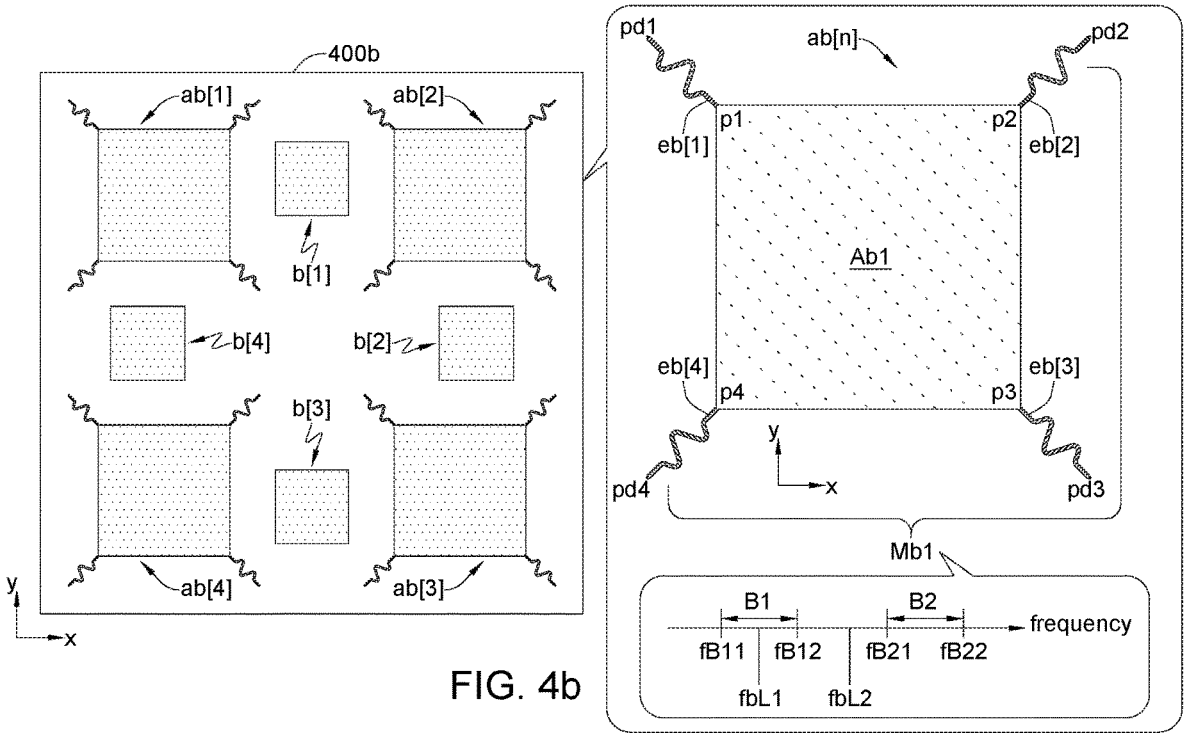

Along with FIG. 2*a*, FIG. 4*b* illustrates a top view of an antenna module 400*b* according to an embodiment of the invention. The antenna module 400*b* in FIG. 4*b* may be derived from the antenna module 200 (FIG. 2*a*) by replacing the low-band antennas a[1] to a[4] with low-band antennas ab[1] to ab[4]. The low-band antennas ab[1] to ab[4] may form a low-band antenna array for signaling at the low-band B1. As shown in FIG. 4*b*, each low-band antenna ab[n] (n=1 to 4) may include a main radiator Mb1, and the main radiator Mb1 may include a basic patch Ab1 and one or more peripheral features, such as eb[1] to eb[4], at a boundary of the basic patch Ab1. The basic patch Ab1 may be a planar conductor parallel to the x-y plane, and a shape of the basic patch Ab1 may be a polygon with vertices at points p1, p2, p3 and p4. Each peripheral feature eb[i] (i=1 to 4) may be connected to the basic patch Ab1 at a respective corner of the basic patch Ab1, and may be a conductive meander line extending outwards from the corner of the basic patch Ab1; for example, the peripheral feature eb[1] may form a zigzagging conductive path extending from the vertex point p1 of the basic patch Ab1 to a tip point pd1 of the main radiator Mb1, and the peripheral feature eb[3] may form a zigzagging conductive path extending from the vertex point p3 of the basic patch Ab1 to a tip point pd3 of the main radiator Mb1. In an embodiment, each antenna ab[n] may be a dual-polarization antenna, a shape of the basic patch Ab1 may therefore be a square, and shapes of the peripheral features eb[1] to eb[4] may be designed such that a shape of the main radiator Mb1 may be rotationally symmetric under 90-degree rotation.

The main radiator Mb1 may resonate at a mode-one frequency fbL1 and a mode-two frequency fbL2 higher than the frequency fbL1; for example, the frequency fbL1 may be a fundamental resonance frequency in a fundamental mode of the main radiator Mb1, and the frequency fbL2 may be a high-order resonance frequency in a high-order mode of the main radiator Mb1. Sizes of the basic patch Ab1 may be configured such that the frequency fbL1 may locate in the low-band B1, and each low-band antenna ab[n] may therefore signal at the low-band B1 for communication. Furthermore, by the peripheral features eb[1] to eb[4], the main radiator Mb1 may be configured such that the frequency fbL2 may not in the high-band B2. The frequency fbL2 of the main radiator Mb1 relates to a length of a conductive path between two diagonal tip points (e.g., pd1 and pd3, or pd2 and pd4) of the main radiator Mb1. If the main radiator Mb1 only contains the basic patch Ab1 without the peripheral features eb[1] to eb[4], the shape of the main radiator Mb1 would degenerate to the plain shape of the basic patch Ab1, and the length of the conductive path between two diagonal tip points of the basic patch Ab1 (e.g., a straight-line distance between the points p1 and p3 or p2 and p4) of such plain shape would cause the frequency fbL2 to locate in the high-band B2 to degrade performances of the high-band antennas b[1] to b[4], similar to what happens to the conventional antenna module 100 (FIG. 1). However, because the main radiator Mb1 further includes the peripheral features eb[1] to eb[4] meandering outwards from the vertex points p1 to p4 of the basic patch Ab1, the length of the conductive path between two tip points of the main radiator Mb1 may be extended (e.g., from the straight-line distance between the points p1 and p3 to a partially meandering path length between the points pd1 and pd3), and the frequency fbL2 may therefore be tuned to be out of the high-band B2, e.g., be tuned to locate between the low-band B1 and the high-band B2, as shown in FIG. 4*b*.

Figure 4C:
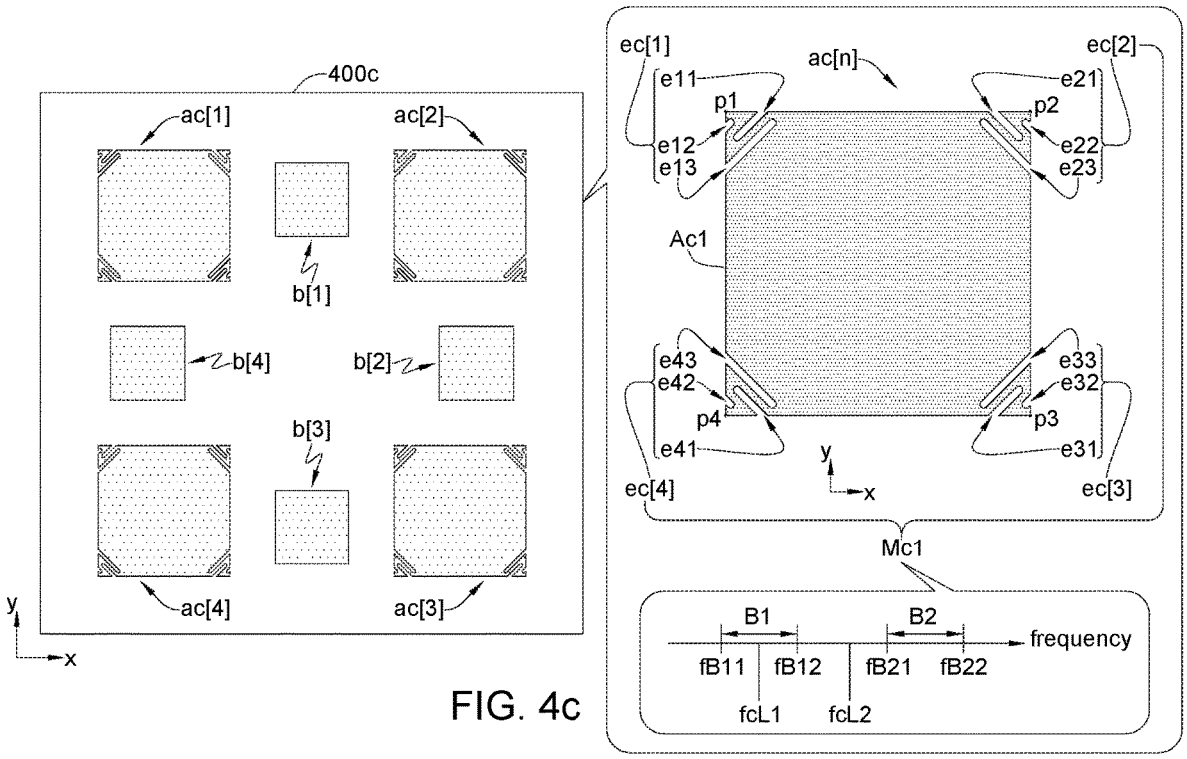

Along with FIG. 2*a*, FIG. 4*c* illustrates a top view of an antenna module 400*c* according to an embodiment of the invention. The antenna module 400*c* in FIG. 4*c* may be derived from the antenna module 200 (FIG. 2*a*) by replacing the low-band antennas a[1] to a[4] with low-band antennas ac[1] to ac[4]. The low-band antennas ac[1] to ac[4] may form a low-band antenna array for signaling at the low-band B1. As shown in FIG. 4*c*, each low-band antenna ac[n] (n=1 to 4) may include a main radiator Mc1, and the main radiator Mc1 may include a basic patch Ac1 and one or more peripheral features, such as ec[1] to ec[4], at a boundary of the basic patch Ac1. The basic patch Ac1 may be a planar conductor parallel to the x-y plane, and a shape of the basic patch Ac1 may be a polygon with vertices at points p1, p2, p3 and p4. Each peripheral feature ec[i] (i=1 to 4) may be arranged at a respective corner of the basic patch Ac1, and may include one or more slits on the basic patch Ac1; for example, the peripheral feature ec[1] at the left-top corner (the point p1) may include slits e11, e12 and e13, the peripheral feature ec[2] at the right-top corner (the point p2) may include slits e21, e22 and e23, the peripheral feature ec[3] at the right-bottom corner (the point p3) may include slits e31, e32 and e33, and the peripheral feature ec[4] at the left-bottom corner (the point p4) may include slits e41, e42 and e43. Each slit of each peripheral feature ec[i] may extend from the boundary of the basic patch Ac1 to interior of the basic patch Ac1. In an embodiment, as each peripheral feature may locate at a corresponding corner of the basic patch Ac1, a subset (none, one, some or all) of the slit(s) of the peripheral feature ec[i] may further be designed to intersect a geometric diagonal of the basic patch Ac1 between the corresponding corner and an opposite corner; for example, the slit e13 of the peripheral feature ec[1] at the left-top corner (point p1) may extend from a left side (line segment between points p1 and p4) of the basic patch Ac1, and may intersect a geometric diagonal of the basic patch Ac1 between the points p1 and p3; similarly, the slit e11 of the peripheral feature ec[1] may extend from a top side (line segment between points p1 and p2) of the basic patch Ac1, and may intersect the geometric diagonal of the basic patch Ac1 between the points p1 and p3. In an embodiment, a subset of the slit(s) of each peripheral feature ec[i] at a corresponding corner of the basic patch Ac1 may extend along a direction perpendicular to a diagonal of the basic patch Ac1 between the corresponding corner and an opposite corner; for example, the slit e13 of the peripheral feature ec[1] at the point p1 may extend along a direction (not shown) perpendicular to the diagonal between the points p1 and p3. In an embodiment, each antenna ac[n] may be a dual-polarization antenna, and a shape of the basic patch Ac1 may therefore be a square.

The main radiator Mc1 may resonate at a mode-one frequency fcL1 and a mode-two frequency fcL2 higher than the frequency fcL1; for example, the frequency fcL1 may be a fundamental resonance frequency in a fundamental mode of the main radiator Mc1, and the frequency fcL2 may be a high-order resonance frequency in a high-order mode of the main radiator Mc1. Sizes (e.g., side lengths) of the basic patch Ac1 may be configured such that the frequency fcL1 may locate in the low-band B1, and each low-band antenna ac[n] may therefore signal at the low-band B1 for communication. Furthermore, by the peripheral features ec[1] to ec[4], the main radiator Mc1 may be configured such that the frequency fcL2 may not in the high-band B2. The frequency fcL2 of the main radiator Mc1 relates to a length of a conductive path between two diagonal points (e.g., p1 and p3, or p2 and p4) of the main radiator Mc1. If the main radiator Mc1 only contains the basic patch Ac1 without the peripheral features ec[1] to ec[4], the shape of the main radiator Mc1 would degenerate to the plain shape of the basic patch Ac1, and the length of the conductive path between two diagonal points of the basic patch Ac1 (e.g., a straight-line distance between the points p1 and p3 or p2 and p4) of such plain shape would cause the frequency fcL2 to locate in the high-band B2 to degrade performances of the high-band antennas b[1] to b[4], similar to what happens to the conventional antenna module 100 (FIG. 1). However, because the main radiator Mc1 of the invention further includes the peripheral features ec[1] to ec[4] which may interrupt the straight-line path between two diagonal points of the main radiator Mc1, the length of the conductive path between two diagonal points of the main radiator Mc1 may be extended (e.g., from the straight-line distance between the points p1 and p3 to a partially meandering path length between the points p1 and p3), and the frequency fcL2 may therefore be tuned to be out of the high-band B2, e.g., be tuned to locate between the low-band B1 and the high-band B2, as shown in FIG. 4*c*.

Figure 4D:
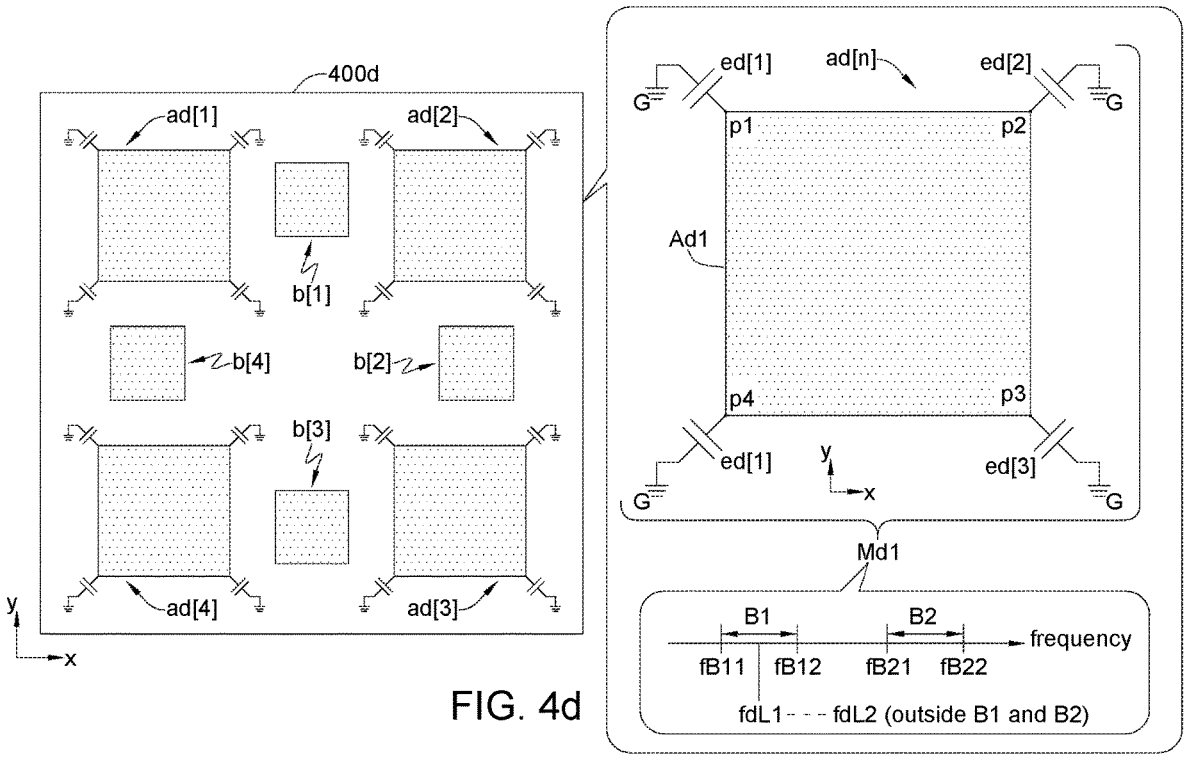

Along with FIG. 2*a*, FIG. 4*d* illustrates a top view of an antenna module 400*d* according to an embodiment of the invention. The antenna module 400*d* in FIG. 4*d* may be derived from the antenna module 200 (FIG. 2*a*) by replacing the low-band antennas a[1] to a[4] with low-band antennas ad[1] to ad[4]. The low-band antennas ad[1] to ad[4] may form a low-band antenna array for signaling at the low-band B1. As shown in FIG. 4*d*, each low-band antenna ad[n] (n=1 to 4) may include a main radiator Md1, and the main radiator Md1 may include a basic patch Ad1 and one or more peripheral features, such as ed[1] to ed[4], at a boundary of the basic patch Ad1. The basic patch Ad1 may be a planar conductor parallel to the x-y plane, and a shape of the basic patch Ad1 may be a polygon with vertices at points p1, p2, p3 and p4. Each peripheral feature ed[i] (i=1 to 4) may be arranged at a corresponding corner of the basic patch Ad1, and may be a capacitor connected between the corresponding corner of the basic patch Ad1 and a ground plane G. For example, the peripheral feature ed[1] at the left-top corner (the point p1) may have a top plate connected to the left-top corner (the point p1) of the basic patch Ad1, and a bottom plate connected to the ground plane G. The basic patch Ad1 may be insulated from the ground plane G.

The main radiator Md1 may resonate at a mode-one frequency fdL1 and a mode-two frequency fdL2 higher than the frequency fdL1; for example, the frequency fdL1 may be a fundamental resonance frequency in a fundamental mode of the main radiator Md1, and the frequency fdL2 may be a high-order resonance frequency in a high-order mode of the main radiator Md1. Sizes (e.g., side lengths) of the basic patch Ad1 may be configured such that the frequency fdL1 may locate in the low-band B1, and each low-band antenna ad[n] may therefore signal at the low-band B1 for communication. Furthermore, by the peripheral features ed[1] to ed[4] which may function as capacitive loads, the main radiator Md1 may be configured such that the frequency fdL2 may not locate in the high-band B2, so as to avoid performance degradation of each high-band antenna and the high-band antenna array.

Figure 5A:
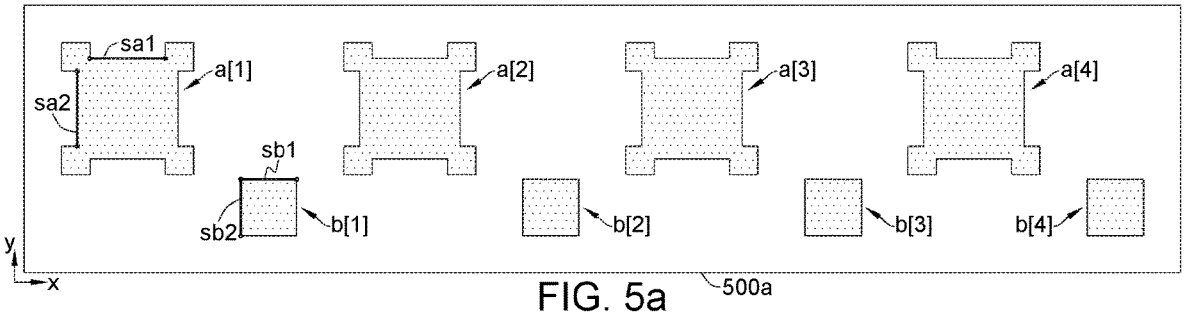
Figure 5B:
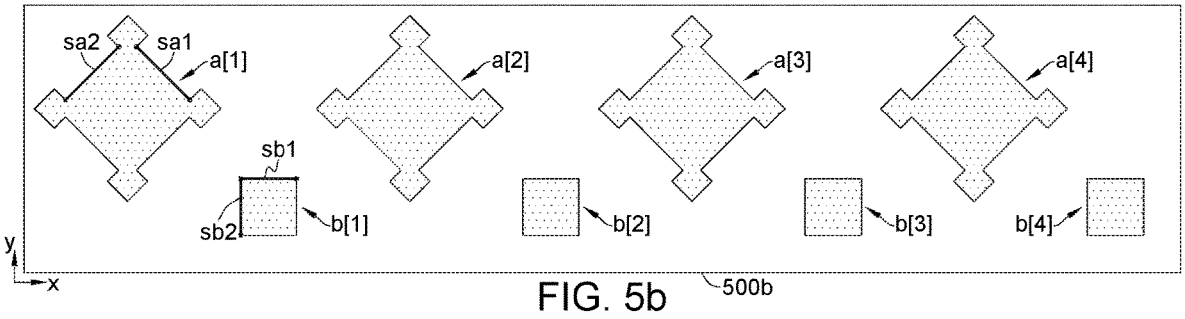

Along with FIGS. 2*a* and 2*b*, FIG. 5*a* illustrates a top view of an antenna module 500*a* according to an embodiment of the invention; the antenna module 500*a* may be derived from the antenna module 200 (FIG. 2*a*) by rearrange positions of the low-band antennas a[1] to a[4] and the high-band antennas b[1] to b[4]; for example, as shown in FIG. 5*a*, the low-band antennas a[1] to a[4] may form a linear antenna array along an array alignment direction (e.g., the x-direction) for signaling at the low-band B1 (FIG. 2*a*), and the high-band antennas b[1] to b[4] may form a linear high-band antenna array also along the array alignment direction for signaling at the high-band B2 (FIG. 2*a*). As shown in FIG. 5*a*, in the antenna module 500*a*, positions of the low-band antennas a[1] to a[4] and the high-band antennas b[1] to b[4] may be arranged to be interleaved for compactness; and, the side sa1 of each antenna a[n] may be arranged to be parallel to the array alignment direction, and the side sb1 of each antenna b[k] may also be arranged to be parallel to the array alignment direction. Similar to the issues of the conventional antenna arrays 102 and 104 (FIG. 1), in an antenna module including closely positioned linear high-band antenna array and linear low-band antenna array, the linear high-band antenna array would suffer performance degradation if a high-order resonance frequency of each low-band antenna falls in the high-band of the linear high-band antenna array. However, in the antenna module 500*a* of the invention, because each low-band antenna a[n] may be configured (e.g., by including the peripheral features e[1] to e[4], FIG. 2*b*) to cause the high-order resonance frequency (e.g., fL2 in FIG. 2*b*) of each antenna a[n] not to fall in the high-band B2 of the high-band antennas b[1] to b[4], overall performances of the antenna module 500*a* may be improved by preventing performance degradation of the high-band antenna array.

Along with FIGS. 2*a* and 5*a*, FIGS. 5*b* to 5*d* respectively illustrate top views of antenna modules 500*b*, 500*c* and 500*d* according to different embodiments of the invention. The antenna modules 500*b*, 500*c* and 500*d* may be derived from the antenna module 500*a* (FIG. 5*a*) by rearrange orientation of each antenna a[n] and/or orientation of each antenna b[k]. In the antenna module 500*b* shown in FIG. 5*b*, the sides sa1 and sa2 of each antenna a[n] may be arranged not to be parallel to the array alignment direction (x-direction), e.g., an angle between the side sa1 and the array alignment direction may be 45 degrees; on the other hand, the side sb1 of each antenna b[k] may be arranged to be parallel to the array alignment direction.

Figure 5C:
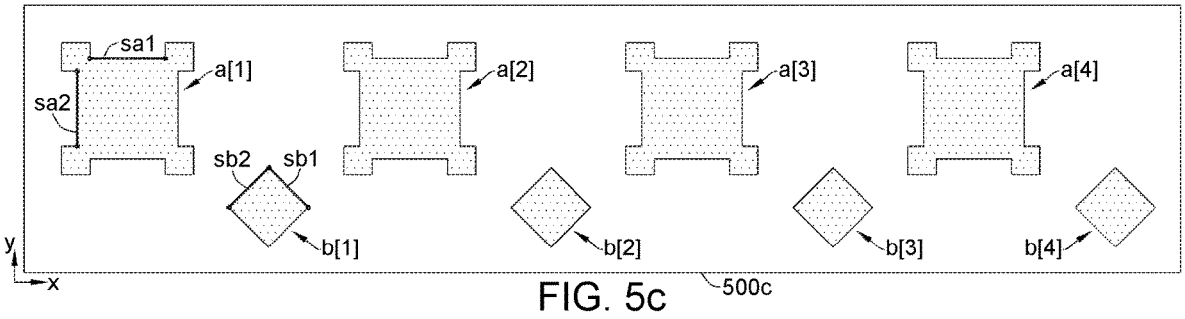
Figure 5D:
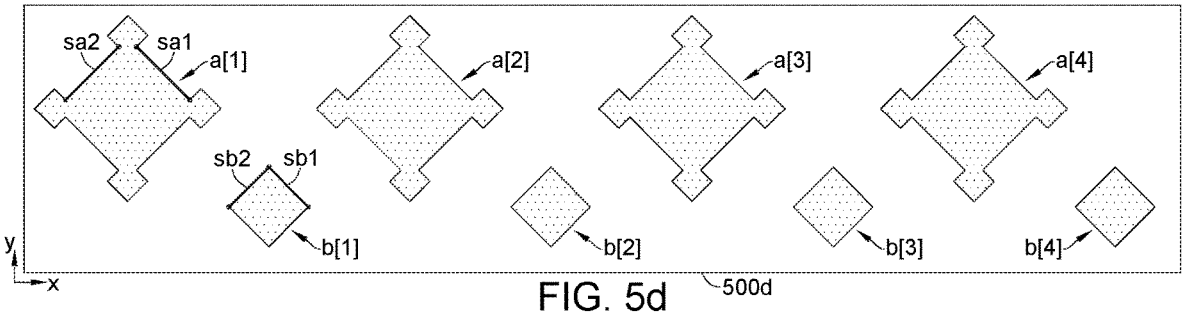

In the antenna module 500*c* shown in FIG. 5*c*, the side sa1 of each antenna a[n] may be arranged to be parallel to the array alignment direction (x-direction), while the sides sb1 and sb2 of each antenna b[k] may be arranged not to be parallel to the array alignment direction; e.g., an angle between the side sb1 and the array alignment direction may be 45 degrees. In the antenna module 500*d* shown in FIG. 5*d*, the sides sa1 and sa2 of each antenna a[n] may be arranged not to be parallel to the array alignment direction (x-direction), e.g., an angel between the side sa1 and the array alignment direction may be 45 degrees; similarly, the sides sb1 and sb2 of each antenna b[k] may also be arranged not to be parallel to the array alignment direction, e.g., an angle between the side sb1 and the array alignment direction may be 45 degrees. According to FIGS. 5*a* and 5*d*, it is understood that each of the sides sa1 and sa2 of each antenna a[n] may be parallel to one of the sides sb1 and sb2 of each antenna b[k]. According to FIGS. 5*b* and 5*c*, it is understood that each of the sides sa1 and sa2 of each antenna a[n] may not be parallel to anyone of the sides sb1 and sb2 of each antenna b[k].

Along with FIGS. 2*a*, 2*b* and 5*b*, FIG. 6 illustrates a top view of an antenna module 600 according to an embodiment of the invention. The antenna module 600 may be derived from the antenna module 500*b* (FIG. 5*b*) by adding one or more parasitic elements (such as R[1] to R[4] and L[1] to L[4]), and further including one or more third-band antennas, e.g., c[1] to c[4], to form a third antenna array signaling at a predefined band B3 between frequencies fB31 and fB32. For example, each of the parasitic elements L[n] and R[n] (n=1 to 4) may be a planar conductor parallel to the x-y plane, and be arranged to be insulated from the antennas a[1] to a[4], b[1] to b[4] and c[1] to c[4]. On the x-y plane, a projection of each of the parasitic elements R[n] and L[n] may be arranged not to overlap with a projection of anyone of the antennas a[1] to a[4], b[1] to b[4] and c[1] to c[4]. A shape of each of the parasitic elements L[n] and R[n] may be a rectangle with longer sides and shorter sides; each parasitic element L[n] may be placed near the side sa2 of each antenna a[n], and a longer side sL1 of the parasitic element L[n] may be arranged to be parallel to the nearby side sa2. Similarly, each parasitic element R[n] may be placed near the side sa1 of each antenna a[n], and a longer side sR1 of the parasitic element R[n] may be arranged to be parallel to the nearby side sa1. The parasitic elements R[n] and L[n] arranged near each antenna a[n] may enhance the bandwidth of each antenna a[n].

Figure 6:
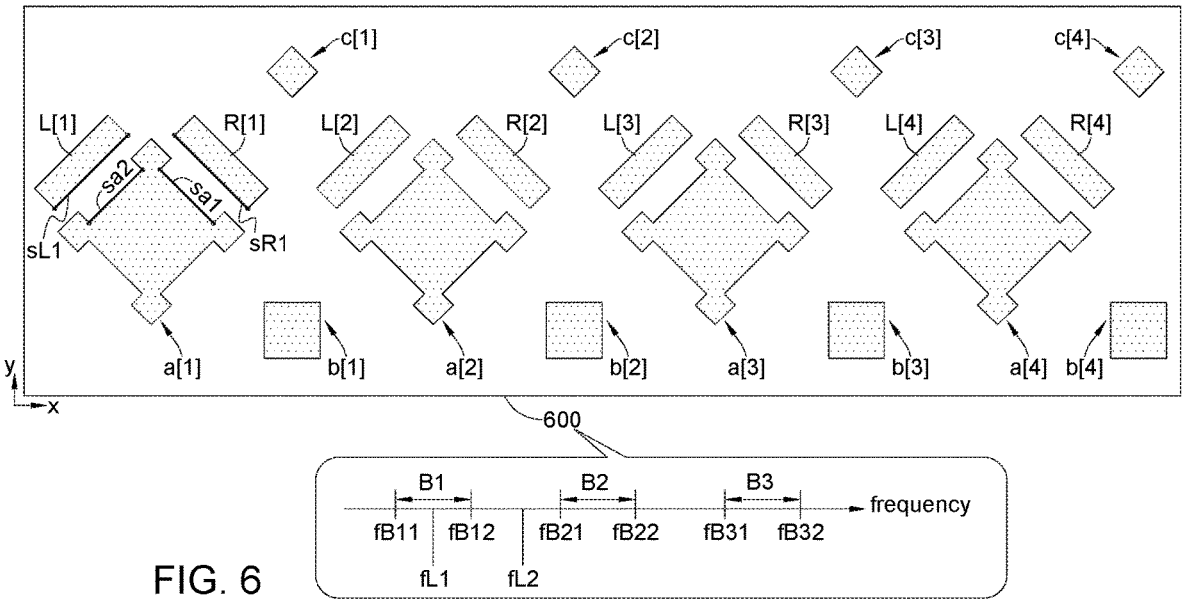

In an embodiment, the band B1 of the antennas a[1] to a[4], the band B2 of the antennas b[1] to b[4] and the band B3 of the antennas c[1] to c[4] may not overlap; for example, as shown in FIG. 6, the band B3 may be higher than the bands B1 and B2 in an embodiment. As previously mentioned, while the resonance frequency fL1 of each antenna a[n] may be arranged to locate in the band B1, each antenna a[n] may also resonate at other high-order frequencies higher than the frequency fL1, such as the frequency fL2. By the peripheral features e[1] to e[4] (FIG. 2*b*), each antenna a[n] of the invention may be configured to cause each of said high-order resonance frequencies of the antenna a[n] to be out of the bands B2 and B3. For example, in addition to the frequency fL2 higher than the frequency fL1, each antenna a[n] (the main radiator M1 of each antenna a[n]) may also resonate at a frequency fL3 (not shown) higher than the frequency fL2, and the frequency fL3 would fall in the band B3 assuming each antenna a[n] does not include the peripheral features e[1] to e[4]. However, with the peripheral features e[1] to e[4] in each antenna a[n], the frequency fL2 may be tuned to locate between the bands B1 and B2, and the frequency fL3 may be tuned to locate between the bands B2 and B3. By configuring said high-order resonance frequencies (e.g., fL2 and fL3) of each antenna a[n] to be out of the bands B2 and B3, undesired high-order resonance of each antenna a[n] may be avoided when the antennas b[1] to b[4] or c[1] to c[4] respectively signal at the bands B2 or B3 for communication. The antennas a[1] to a[4] of the invention may therefore improve overall performances of the antenna module 600 by preventing performance degradation of the antennas b[1] to b[4] and c[1] to c[4].

In an embodiment, if a high-order resonance frequency fH2 (not shown) of each antenna b[k] locates in the band B3, each antenna b[k] may further include one or more its own peripheral features (not shown), similar to the peripheral feature e[i], ea[i], eb[i], ec[i] or ed[i] in FIG. 2*a*, 4*a*, 4*b*, 4*c* or 4*d*, so the frequency fH2 may be tuned to locate outside of the band B3, and undesired high-order resonance of each antenna b[k], which may cause performance degradation of the antennas c[1] to c[4], may therefore be avoided when each antenna c[n] signals at the band B3.

In an embodiment (not shown), the band B3 may be higher than the band B1 but lower than the band B2, and the high-order resonance frequency fL2 of each antenna a[n] may be tuned to locate between the bands B1 and B3, or between the bands B3 and B2.

In an embodiment, similar to the antenna module 600 in FIG. 6, the antenna module 200, 300, 400*a*, 400*b*, 400*c*, 400*d*, 500*a*, 500*b*, 500*c* or 500*d* (FIG. 2*a*, 3, 4*a*-4*d*, 5*a*-5*d*) may further include one or more additional antennas (e.g., c[1] to c[4] in FIG. 6) to form one or more additional antenna array for signaling at one or more predefined bands (e.g., B3 in FIG. 6) other than the predefined bands B1 and B2, and each antenna in the antenna module may be configured according to the invention such that a high-order resonance frequency of each antenna may not fall in all predefined bands of the antenna module. For example, the antenna module 400*a* in FIG. 4*a* may further include one or more third-band antennas (not shown in FIG. 4*a*) for signaling at a third predefined band B3 (not shown in FIG. 4*a*) higher than the band B2, and, by the peripheral features ea[1] to ea[4], the frequency faL2 of each antenna ac[i] may configured to be between the bands B2 and B3, or be higher than the band B3.

Similar to the antenna a[n] in FIGS. 2*a* and 2*b*, each of the antennas aa[n] to ad[n] in FIGS. 4*a* to 4*d* may be a simple patch antenna or a stacked patch antenna. Each of the antennas aa[n] to ad[n] in FIGS. 4*a* to 4*d* may adopt direct feed or slot coupling for feeding.

According to the invention, other different antenna module (not shown) may be derived from the antenna module 200, 300, 500*a*, 500*b*, 500*c*, 500*d* or 600 (FIG. 2*a*, 3, 5*a* to 5*d* or 6) by replacing each low-band antenna a[n] with one of the low-band antennas aa[n] to ad[n] in FIGS. 4*a* to 4*d*. And, more different antenna modules may be derived from the antenna module 200, 400*a*, 400*b*, 400*c* or 400*d* (FIG. 2, 4*a*, 4*b*, 4*c* or 4*d*) by rearranging orientation of each antenna a[n], aa[n], ab[n], ac[n] or ad[n] and/or orientation of each antenna b[k], similar to deriving the antenna module 500*b*, 500*c* or 500*d* (FIG. 5*b*, 5*c* or 5*d*) from the antenna module 500*a* (FIG. 5*a*).

To sum up, the multi-band antenna module of the invention may include at least a high-band antenna array and a low-band antenna array respectively for radio communication at a high-band and a low-band, wherein each low-band antenna in the low-band antenna array may be configured to tune its high-order resonance frequency away from the high-band, so the multi-band antenna module of the invention may improve performances by avoiding performance degradation of the high-band antenna array caused by undesired high-order resonance of the low-band antennas.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An antenna module of improved performances, comprising:

a plurality of first antennas for signaling at a first band; and a plurality of second antennas for signaling at a second band different from the first band; wherein:

each said first antenna comprises a main radiator which resonates at a mode-one frequency and a mode-two frequency different from the mode-one frequency; and the main radiator is configured such that the mode-one frequency is in the first band, and the mode-two frequency is not in the first band and the second band.

2. The antenna module of claim 1, wherein the main radiator is configured such that the mode-two frequency is between the first band and the second band.

3. The antenna module of claim 1, wherein the main radiator is configured such that the mode-two frequency is higher than the first band and the second band.

4. The antenna module of claim 1, wherein the main radiator comprises:

a basic patch; and at least one peripheral feature at a boundary of the basic patch, for tuning the mode-two frequency out of the second band.

5. The antenna module of claim 4, wherein a shape of the basic patch is a polygon, and each said peripheral feature is at a corner of the basic patch.

6. The antenna module of claim 4, wherein each said peripheral feature is an extension patch extending outwards from the boundary of the basic patch.

7. The antenna module of claim 6, wherein a shape of each said peripheral feature is a polygon.

8. The antenna module of claim 4, wherein each said peripheral feature is an indentation extending inwards from the boundary of the basic patch.

9. The antenna module of claim 4, wherein each said peripheral feature is a meander line.

10. The antenna module of claim 4, wherein each said peripheral feature comprises one or more slits.

11. The antenna module of claim 4, wherein each said peripheral feature is a capacitor connected between a ground plane and the basic patch.

12. The antenna module of claim 4, wherein a shape of the basic patch is a square.

13. The antenna module of claim 1 further comprising one or more parasitic elements near at least one of the plurality of first antennas, for enhancing a bandwidth of the plurality of first antennas.

14. The antenna module of claim 1, wherein a side of each said first antenna is parallel to a side of each said second antenna.

15. The antenna module of claim 1, wherein a side of each said first antenna is not parallel to any side of each said second antenna.

16. An antenna module of improved performances, comprising:

a plurality of first antennas for signaling at a first band; and a plurality of second antennas for signaling at a second band different from the first band;

wherein each said first antenna resonates at a mode-one frequency and a mode-two frequency different from the mode-one frequency; the mode-one frequency is in the first band, and each said first antenna comprises at least one peripheral feature for tuning the mode-two frequency out of the second band.

17. The antenna module of claim 16, wherein each said first antenna further comprises a basic patch, and each said peripheral feature is at a boundary of the basic patch.

18. The antenna module of claim 17, wherein each said peripheral feature is an extension patch extending outwards from the boundary of the basic patch.

19. The antenna module of claim 17, wherein each said peripheral feature is an indentation extending inwards from the boundary of the basic patch.

20. The antenna module of claim 16, wherein each said peripheral feature is a meander line.

* * * * *